United States Patent [19]

Matsutani

[11] 4,214,382

[45] Jul. 29, 1980

[54] TRAINING BAR

[76] Inventor: Shin Matsutani, 1093 W. 26th St., #4, San Pedro, Calif. 90731

[21] Appl. No.: 930,923

[22] Filed: Aug. 4, 1978

[51] Int. Cl.[3] ..... A63K 3/00

[52] U.S. Cl. ..... 35/29 R; 119/96; 273/DIG. 19; 273/DIG. 27

[58] Field of Search ..... 35/29 R, 29 B, 29 C, 35/29 D, 29 E, 29 F; 119/96; 272/67, 135, 137, DIG. 5, 130, 141, 142; 273/DIG. 27, DIG. 19; 280/480; 135/75

[56] References Cited

U.S. PATENT DOCUMENTS

| | | | |
|---|---|---|---|
| 1,023,756 | 4/1912 | Pons | 272/DIG. 5 X |
| 1,217,709 | 2/1917 | Cobel | 135/75 |
| 2,108,566 | 2/1938 | Sanders | 119/96 |
| 3,014,284 | 12/1961 | Hall | 35/29 R |
| 3,458,188 | 7/1969 | Infante | 273/DIG. 19 X |
| 4,077,625 | 3/1978 | Clarke | 273/DIG. 19 X |

FOREIGN PATENT DOCUMENTS

| | | | |
|---|---|---|---|
| 1012574 | 6/1977 | Canada | 272/141 |

OTHER PUBLICATIONS

Bell Telephone Magazine, Nov./Dec., 1970, p. 11 only.

*Primary Examiner*—Harland S. Skogquist
*Attorney, Agent, or Firm*—Blakely, Sokoloff, Taylor & Zafman

[57] ABSTRACT

A training bar to be worn simultaneously by a sighted and a non-sighted runner. The bar comprises a central rod approximately four and one half feet in length having a shock absorber disposed at either end. A belt or harness to be worn around the waist of the runners is attached to each shock absorber with the sighted runner wearing the belt with one end of the bar attached at the rear. The non-sighted runner wears the other belt with the remaining end of the bar attached at the front, so that when the pair are running in tandem they are separated by the length of the training bar. The separation permits both runners to run freely without interfering with one another. A change in the lead runner's speed or direction will be transmitted through the bar to the rear runner. Any shock created by a sudden stop or change in direction will be absorbed by the two shock absorbers.

3 Claims, 5 Drawing Figures

TRAINING BAR

BACKGROUND OF THE INVENTION

1. Field of the Invention

The present invention relates to exercising equipment and more particularly to a training bar for guiding a visually handicapped runner.

2. Description of the Prior Art

In the past several years there has been an upsurge in the popularity of exercise, especially exercise of the aerobic variety which requires vigorous prolonged exertion. Aerobic exercise is known to provide many benefits including the strengthening of the cardiovascular system (heart, lungs and blood vessels). One of the most popular sources of aerobic exercise is running which requires little or no equipment and can be done almost anywhere.

Individuals who are blind or are otherwise visually handicapped are unable to safely enjoy many of the benefits of running. Running in place or running on a treadmill is often found to be wearisome or monotonous and therefore unacceptable. If street or track running is attempted, the handicapped persons presently must grasp from the rear the waist or shoulders of a sighted person running ahead of him. This form of running is disadvantageous in that neither runner can run naturally or freely. If either runner runs with a natural stride, the other person's running will be interfered with, consequently both runners must run with a short, awkward gait. Furthermore, the non-sighted person must run stooped over with both arms extended forward rather than swinging naturally.

An apparatus which would permit a visually handicapped person to run naturally on a track or crosscountry would be ideal. Such an apparatus should be light in weight, low in cost and easily transportable. Furthermore, such an apparatus should permit relatively hazard-free running, even in the presence of obstacles such as trees or the like.

SUMMARY OF THE INVENTION

The present invention relates to a training bar to be worn by two runners, one of whom is nonsighted or otherwise visually handicapped. The training bar comprises a central rod, which is preferably made of aluminum, approximately four and one half feet in length. A belt or harness to be worn around the waist of the runners is attached to either end of the rod through a shock absorber.

The belt of the sighted runner is worn with the rod attached to the runner's rear while the handicapped runner's belt is attached to the rod at a position on the belt in front of the runner. The two runners run in tandem with the sighted person leading. The runners are separated by the training bar a predetermined length, such separation permitting both runners to run with a free and natural gait. Any change in the lead runner's speed or direction of travel can immediately be sensed by the rear runner through the training bar. The rear runner can run erect with his arms free, although it may be desirable to periodically grasp the training bar to precisely determine the lead runner's direction of travel. Should the lead runner slow down, stop abruptly or suddenly change direction, the two shock absorbers will absorb any resulting jarring or shock.

DETAILED DESCRIPTION OF THE INVENTION

Figure 1:
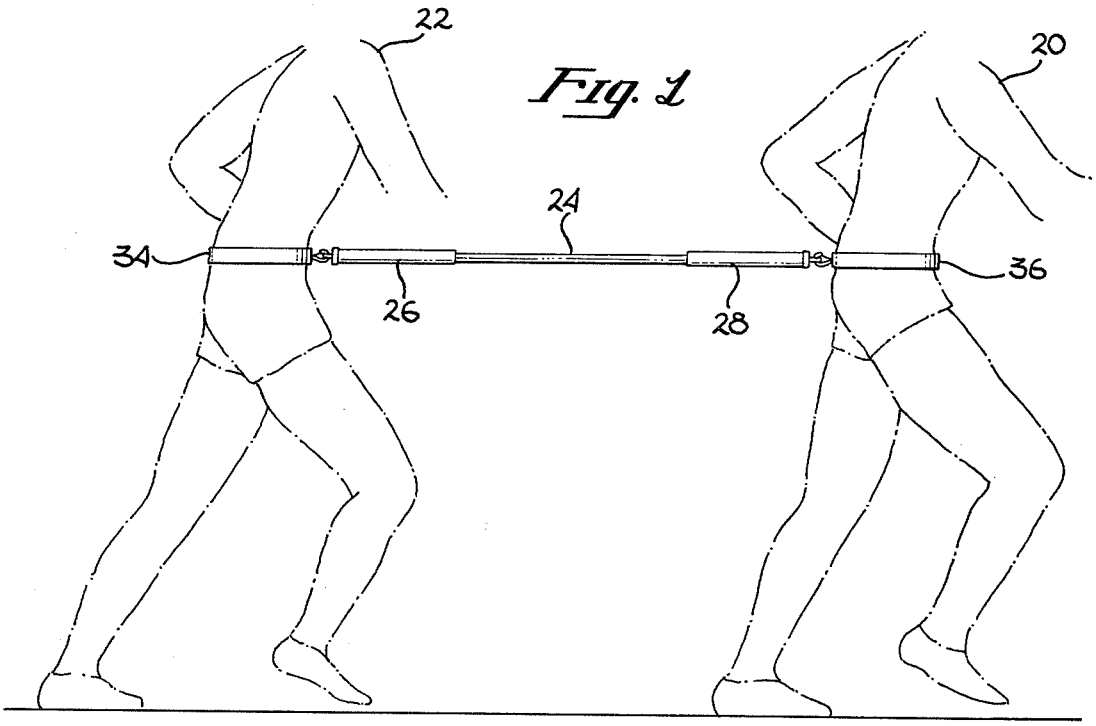
FIG. 1 is a side view of one embodiment of the training bar showing the bar in use.

Referring to the drawings, FIGS. 1 through 4 illustrate one embodiment of the invention. FIG. 1 shows two runners 22 and 20 using the first embodiment of the training bar. The bar includes a central rod or tube 24 having shock absorber housings 26 and 28 disposed at the rear and forward ends, respectively. Shock absorber housing 28 is coupled to a belt or harness 36 worn around the waist of the lead or sighted runner 20. Correspondingly, shock absorber housing 26 is coupled to a belt or harness 34 worn by the rear or non-sighted runner 22.

Figure 2:
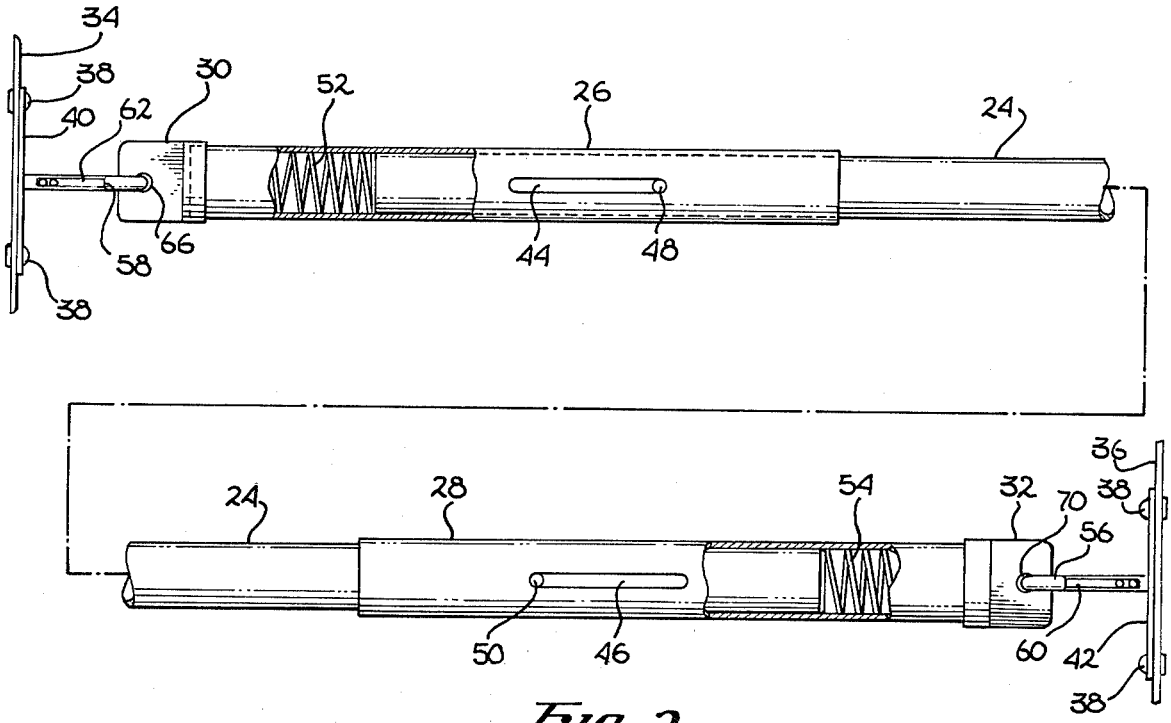
FIG. 2 is a partial, fragmentary plan view of the bar which illustrates some of the details of the shock absorbing mechanism.
Figure 3:
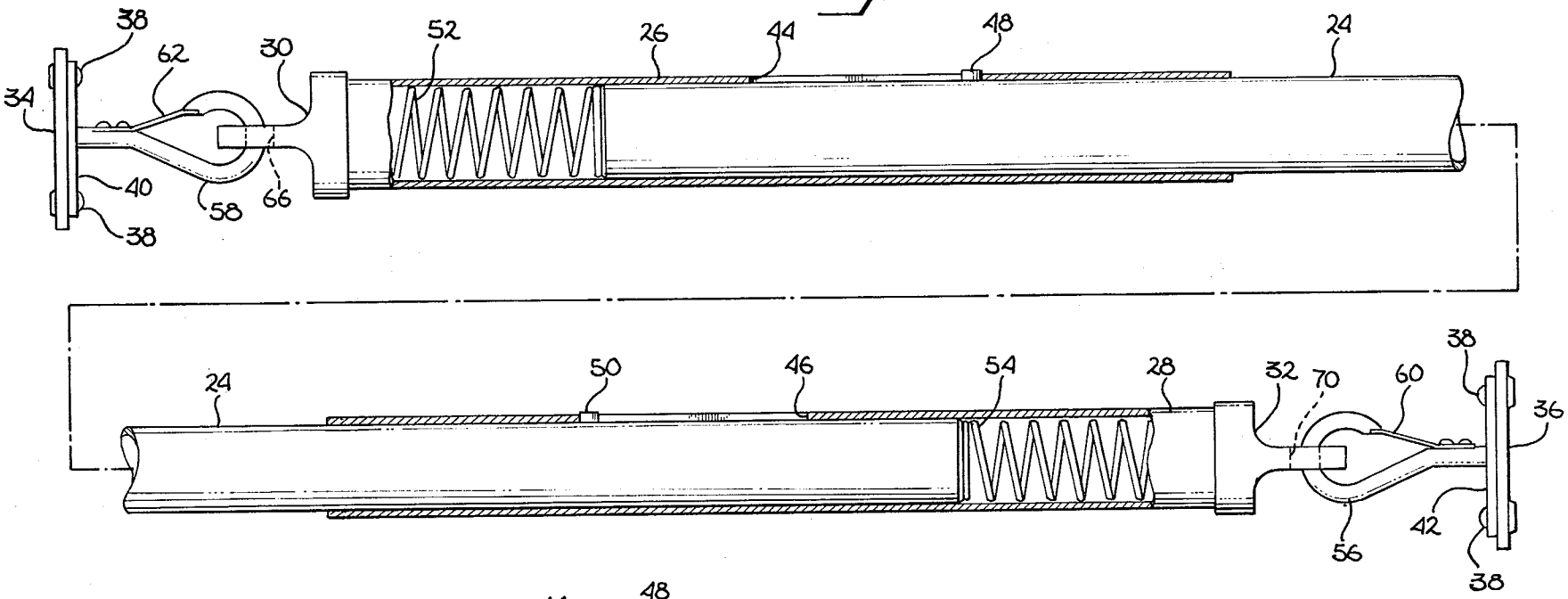
FIG. 3 is a partial, fragmentary side view of the bar.

FIGS. 2 and 3 show some of the details of the training bar. The central tube 24 is approximately four and one half feet in length and is preferably made of aluminum. Aluminum conduit would be satisfactory as would aluminum alloy tubing, titanium tubing or tubing made of rigid plastic or the like. Shock absorbers of similar construction are situated at either end of tube 24. The rear absorber includes a tubular shock absorber housing 26, preferably made of aluminum, having an inside diameter slightly larger than the outside diameter of central tube 24. The outer end of the housing 26 terminates in a cap 30 which includes a member having an opening 66 suitable for accepting a rear clasp 58. Cap 30, also preferably made of aluminum, is secured to the rear shock absorber housing 26 by heli-arc welding or by an epoxy adhesive.

Figure 4:
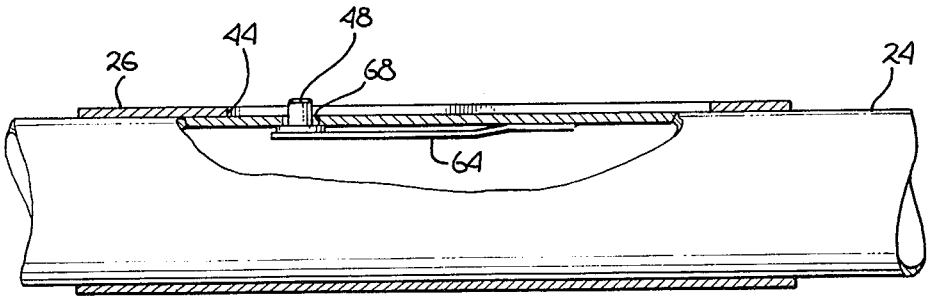
FIG. 4 is a partial, fragmentary side view of the bar illustrating the details of the locking pin mechanism.

Shock absorber housing 26 is slideably fitted over the rear end of tube 24 and retained thereon by a slot 44 formed in the housing which receives a retaining pin 48. Referring momentarily to FIG. 4, retaining pin 48 is attached to one end of a reed spring 64, the other end of the spring being attached to the inner wall of tube 24 by riveting or other suitable means. In the normal position, retaining pin 48 extends through an opening 68 in central tube 24 into slot 44. The shock absorber housing 26 may be detached from the training bar by simultaneously depressing retaining pin 48 towards the center of tube 24 until the upper surface of the pin clears the absorber housing and pulling the housing outwardly away from the center of the tube. Similarly, the housing 26 may be reconnected by simultaneously depressing pin 48 and sliding the housing over the end of tube 24 until the pin snaps into position in slot 44.

A helical spring 52 is disposed within housing 26 with one end positioned adjacent to the inner surface of cap 30 and the other end adjacent to one end of tube 24. The diameter of spring 52 is slightly less than the inside diameter of housing 26, and preferably approximately the same as the outside diameter of tube 24. The length of spring 52 is such that the spring is normally slightly compressed and exerting an outwardly directed force on housing 26 so that retaining pin 48 is butted up against one end of slot 44. When an opposing inwardly directed force is applied to cap 30, housing 26 will move inwardly thereby compressing spring 52 until retaining pin 48 is adjacent to the opposite end of slot 44.

Shock absorbing mechanisms are preferably located at both ends of the training bar although a single mechanism at either end or in the center would be adequate. The shock absorbing mechanism at the lead end of the training bar is similar in construction to the mechanism at the trailing end. The lead mechanism includes a shock absorber housing 28 terminating in a cap 32. The housing 28 is retained on rod 24 by a retaining pin 50 which fits within a slot 46 formed in the housing. Similarly, a helical spring 54 is disposed within the housing 28, said spring being normally compressed between one end of tube 24 and the inner surface of cap 32. Operation of the lead end absorber is identical to that of the trailing end.

The training bar is attached to belts 34 and 36 worn by the non-sighted and sighted runners 22 and 20, respectively. The belts 34 and 36 are preferably leather although belts made of heavy fabric webbing would also be suitable. Both belts are provided with a buckle (not shown). A rear bracket plate 40 is securely attached to the front of rear belt 34 by means of a plurality of rivets 38. A rear clasp 58 is in turn rigidly affixed to the central region of plate 40 by welding or other similar means. Rear clasp 58 includes a retaining spring 62 which extends over the clasp opening. The free end of spring 62 is positioned with respect to the end of the clasp such that the spring can be momentarily deflected inwardly by cap 30 when the clasp is being fastened in opening 66. As can best be seen in FIG. 3, spring 62 is prevented from deflecting outwardly by the end of clasp 58, consequently the clasp can be disconnected from cap 30 only by first manually depressing the spring inwardly. This feature prevents the training bar from accidentally slipping out of clasp 58 and perhaps striking the runner.

The leading end of the training bar is connected to the belt 36 worn by the lead or sighted runner 20 in a manner similar to the manner of connecting the bar to the rear runner 22. A clasp 56 is welded or otherwise securely attached to a bracket plate 42 which is in turn secured to the belt 36 by a plurality of rivets 38. Of course, plate 42 is attached to the rear of belt 36 since the belt is worn by the lead runner. The cap 32 is provided with an opening 70 for receiving clasp 56, the clasp being retained therein by a retaining spring 60.

Operation of the training bar is straightforward. The runners first strap on the belts 34 and 36 and then connect the training bar to the respective clasps 58 and 56 attached to the belts. Since both ends of the bar are identical, it makes no difference which end is attached to which runner. The runners then begin running in tandem with the non-sighted runner 22 following behind the sighted runner 20. Any changes in direction or speed by the lead runner can be immediately detected by the rear runner through the training bar. Should the lead runner stop or slow down abruptly or change directions suddenly, the resulting compression forces on the bar will be aborbed by the two shock absorber mechanisms. Trial runs have demonstrated that a training bar of approximately four and one half feet in length is ideal. If the bar is substantially shorter, the runners will interfere with each other's running, whereas if the bar is substantially longer, the non-sighted runner is less able to detect changes in the lead runner's direction of travel.

Figure 5:
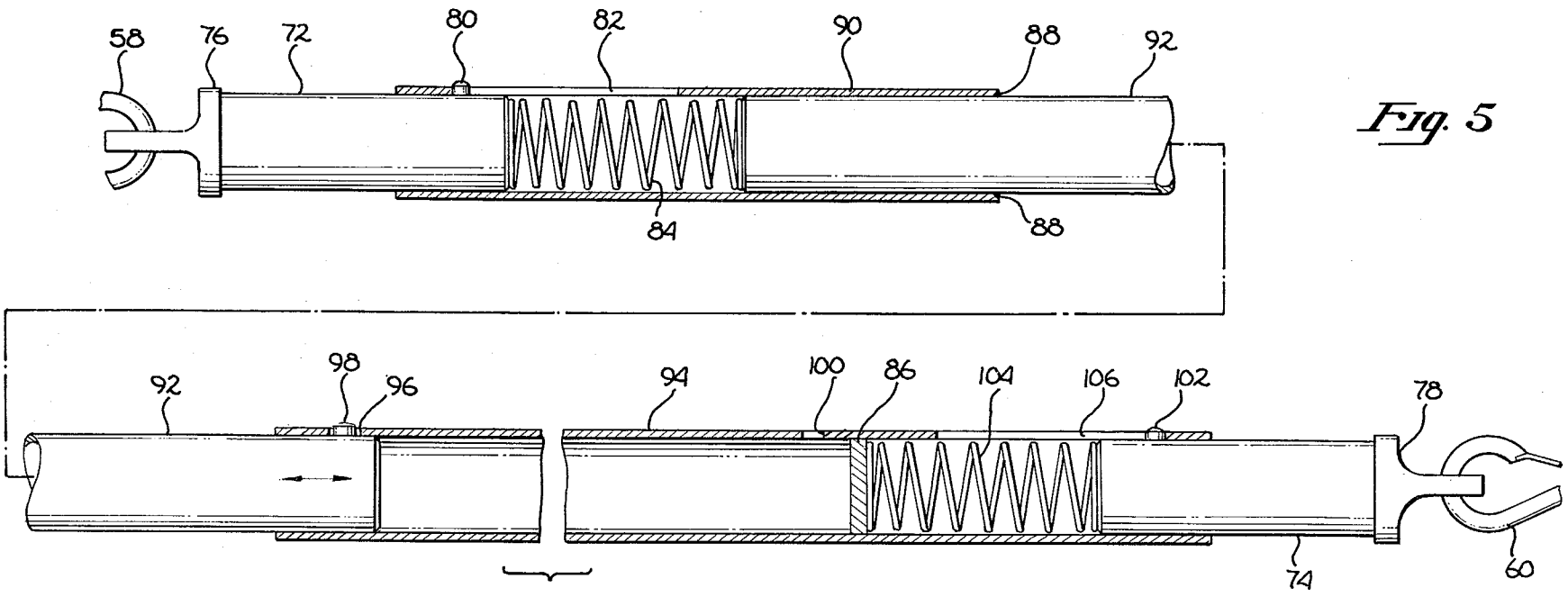
FIG. 5 is a partial, fragmentary side view of another embodiment of the bar.

FIG. 5 illustrates another embodiment of the subject invention. This embodiment, which is similar to the embodiment previously disclosed, includes a means whereby the bar may be collapsed for storage. Referring now to FIG. 5, it can be seen that the bar includes a two-piece central member comprised of tubes 92 and 94. One end of tube 92 extends a short distance inside a sleeve 90 and is rigidly secured therein by welds 88 or other suitable means. The remaining end of tube 92 is slideably mounted within tube 94 and is secured therein by a spring-biased retaining pin 98. Pin 98 is mounted on tube 94 in the same manner pin 48 is mounted on tube 24 of the first embodiment bar as shown in FIG. 4. Openings 96 and 100 are formed in tube 94 to receive pin 98. FIG. 5 shows the bar in the extended or operating position with pin 98 positioned in opening 96. The bar is placed in the stowed or non-operating position by depressing pin 98 and telescoping tube 92 into tube 94 until the pin engages opening 100. Tubes 92 and 94 are provided with markings (not shown) to assist in aligning the tubes both axially and radially so that pin 98 may be readily positioned in either opening 96 or opening 100.

Shock absorbers are disposed at both ends of the second embodiment bar just as they were in the first embodiment. The rear shock absorber includes a spring 84 disposed within sleeve 90. A cylindrically-shaped member 72 having a spring-biased retaining pin 80 is also disposed within sleeve 90. Retaining pin 80, which is mounted on member 72 in the same manner pin 98 is mounted on tube 92, engages a slot 82 formed in sleeve 90. Spring 84, which is normally slightly compressed between member 72 and tube 92, tends to force pin 82 into engagement with the rear end of slot 82. When a compressive force is exerted on the training bar, member 72 will slide further into sleeve 90 thereby tending to further compress spring 84 until retaining pin 80 contacts the forward end of slot 82.

A cap 76 is secured to the outer end of member 72 either by welding or by an epoxy adhesive. Cap 76 is provided with an opening for receiving a clasp 58 which is in turn fastened to a belt worn by the rear runner in the same manner as previously described in the first embodiment.

The forward shock absorber also includes a spring 104 which is disposed within the outer portion of tube 94. A member 74, identical in construction to member 72, is slideably mounted within tube 94 and retained therein by a spring-biased retaining pin 102, similar to pin 80, which engages a slot 106 formed in the tube. Spring 104 is normally slightly compressed between a baffle 86 formed in the interior of tube 94 and the end of member 74. When a compressive force is exerted on the training bar, member 74 will slide further into tube 94 causing spring 104 to compress until retaining pin 102 has traveled from the outer end of slot 106 to the inner end.

The forward end of the training bar is attached to the lead runner by way of a cap 78 attached to the forward end of member 74. An opening is formed in forward cap 78 for receiving a clasp 60 which is in turn connected to the rear of a belt worn by the lead runner in the same manner as described in the first embodiment training bar.

Operation of the second embodiment training bar is identical to that of the first embodiment. Of course, the second bar must first be extended from the stowed position by simultaneously depressing pin 98 and pulling apart tubes 92 and 94 so that the pin will disengage from opening 100 and engage in opening 98. After use, the bar is stowed by again depressing pin 98 and telescoping tube 92 into tube 94 until the pin engages opening 100. The markings on the two tubes 92 and 94 are used for aligning the tubes so that pin 98 can be engaged in either opening 96 or 100 without undue manipulation.

There has been described herein two embodiments of the present invention. It is noted, however, that alternate embodiments may be readily fabricated by one skilled in the art. For example, it is apparent that either shock absorber assembly of the first embodiment bar may be substituted for the rear shock absorber assembly of the second embodiment bar. Thus while two embodiments of the present invention have been described herein, various changes in the form or detail may be made therein without departing from the spirit and scope of the invention.

I claim:

1. A training bar for use with first and second runners, said training bar comprising:

a substantially rigid elongated member having first and second ends;

a first belt to be worn by said first runner, said first belt being coupled to said first end of said member;

a second belt to be worn by said second runner, said second belt being coupled to said second end of said member;

a first shock absorber disposed between said first end of said member and said first belt;

said elongated member being of sufficient length that when said bar is worn by the runners, neither runner interferes with the running of the other when the two runners are running in tandem.

2. The training bar of claim 1 wherein the bar further includes a second shock absorber disposed between said second end of said member and said second belt.

3. The training bar of claim 1 wherein said elongated member comprises first and second tubes, said first tube being slideably mounted within said second tube, said bar further including a retaining means coupled to said tubes for selectively securing said tubes in a stowed position wherein said first tube is substantially telescoped within said second tube and in an unstowed position wherein said first tube is substantially withdrawn from said second tube.

* * * * *